US010406042B2

(12) United States Patent
Boak

(10) Patent No.: US 10,406,042 B2
(45) Date of Patent: Sep. 10, 2019

(54) SPINE BOARD WITH CLEATS FOR SECURING A PATIENT

(71) Applicant: Stepehn Raine Boak, Bergenfield, NJ (US)

(72) Inventor: Stepehn Raine Boak, Bergenfield, NJ (US)

( * ) Notice: Subject to any disclaimer, the term of this patent is extended or adjusted under 35 U.S.C. 154(b) by 0 days.

(21) Appl. No.: 15/626,154

(22) Filed: Jun. 18, 2017

(65) Prior Publication Data

US 2017/0360631 A1 Dec. 21, 2017

Related U.S. Application Data

(62) Division of application No. 14/275,913, filed on May 13, 2014, now Pat. No. 9,707,137.

(51) Int. Cl.

| | |
|---|---|
| ***A61G 1/00*** | (2006.01) |
| ***A61G 1/044*** | (2006.01) |
| ***A61G 1/048*** | (2006.01) |
| ***A61G 7/10*** | (2006.01) |

(52) U.S. Cl.

CPC ..... *A61G 1/00* (2013.01); *A61G 1/044* (2013.01); *A61G 1/048* (2013.01); *A61G 7/103* (2013.01)

(58) Field of Classification Search

CPC ..... A61G 1/04; A61G 1/044; A61G 1/048; A61G 1/00; A61G 7/103; A61G 7/05; A61G 7/0503; A61G 13/10; A61G 13/101; A61F 5/37; A61F 5/3707; A61F 5/3761; A61F 5/3769; A61F 5/3776; A47C 21/00; A47C 21/02; A47C 31/00

USPC ..... 5/628, 625, 503.1, 658; 128/869, 870, 128/876

See application file for complete search history.

(56) References Cited

U.S. PATENT DOCUMENTS

| | | | | |
|---|---|---|---|---|
| 4,369,982 A * | 1/1983 | Hein | B62B 1/18 | 128/870 |
| 4,519,106 A * | 5/1985 | Sandquist | A61F 5/05883 | 128/876 |
| 4,655,206 A * | 4/1987 | Moody | A61G 1/01 | 5/628 |

(Continued)

*Primary Examiner* — Robert G Santos
(74) *Attorney, Agent, or Firm* — John J. Daniels, Esq.

(57) ABSTRACT

A spine board for evacuating a patient from an accident site. At least one cleat is positioned on a longitudinal edge of the spine board and having a proximal end coupled to the spine board, and a distal end disposed away from the spine board and formed in a hook shape, so that securing means, such as straps, can be quickly attached to the cleat to secure to the spine board, the head of a patient placed on the spine board, the head immobilizer placed at the sides of the head, and a cervical collar wrapped around the neck of the patient, without having to lift the spine board off the ground the spine board while the patient laying thereon, and that can be used in any weather or ambient light conditions, and can even be attached by feel. In accordance with an exemplary embodiment, the cleat is coupled to a groove or on an axle extending along a longitudinal edge of the spine board and positioned adjustably along the groove. In accordance with another exemplary embodiment, a retrofittable cleat array includes a cleat support structure is fixed to a top plate. The cleat support structure and the cleat are insertable into a through-slot in a pre-existing board.

20 Claims, 17 Drawing Sheets

(56) References Cited

U.S. PATENT DOCUMENTS 4,794,656 A * 1/1989 Henley, Jr. ..... A61G 1/01 5/628
5,435,323 A * 7/1995 Rudy ..... A61F 5/05883 128/870
5,473,784 A * 12/1995 Nixon ..... A61B 6/0442 5/601
5,934,282 A * 8/1999 Young, III ..... A61G 1/00 128/870
5,950,627 A * 9/1999 Bologovsky ..... A61G 1/00 128/869
6,435,188 B2 * 8/2002 Tyrrell ..... A61F 5/055 128/870
6,715,170 B2 * 4/2004 Richmond ..... A61G 1/00 128/870
7,028,357 B2 * 4/2006 Holland ..... A61G 1/00 128/870
7,303,705 B2 * 12/2007 Panton, Jr. ..... A61B 6/0442 264/46.4
9,707,137 B2 * 7/2017 Boak ..... A61G 1/00
2002/0002977 A1 * 1/2002 Tyrrell ..... A61F 5/055 128/870
2003/0213066 A1 * 11/2003 Richmond ..... A61G 1/00 5/625
2004/0060115 A1 * 4/2004 Panton, Jr. ..... A61B 6/0442 5/625
2004/0187214 A1 * 9/2004 Holland ..... A61G 1/00 5/626
2007/0240815 A1 * 10/2007 Panton, Jr. ..... A61B 6/0442 156/281
2012/0255565 A1 * 10/2012 Hursh ..... A61G 1/00 128/870
2015/0328065 A1 * 11/2015 Boak ..... A61G 1/00 5/628

* cited by examiner

SPINE BOARD WITH CLEATS FOR SECURING A PATIENT

RELATED APPLICATIONS

This application is a divisional patent application of U.S. patent application Ser. No. 14/275,913, filed on May 13, 2014, the disclosure of which is incorporated by reference.

FIELD OF THE INVENTION

This invention relates to spine boards, sometimes known as spine boards or long boards, and more particularly to an improved means for securing a patient thereon for transport to a medical facility.

BACKGROUND OF THE INVENTION

The process of rescuing a person suspected of suffering spinal trauma is well known. Generally, the patient is prepared for transport by the emergency medical team by first attaching a cervical collar to immobilize the head, neck and shoulders so that they are kept as motionless as possible with regard to each other. Depending on the type and nature of the accident, it is the goal of the rescue team to get the patient on a spine board to limit motion of the patient. Once on the board, the patient's head is further restrained from movement by placing a head immobilizer on the board at each side of the patient's head. There are a number of products and methods available for accomplishing this task from blanket rolls on each side of the head, to padded vertical plates that can be attached to the spine board via board engagement means such as hook and loop fasteners.

Next the patient's head is secured to the board with any number of restraint means such as but not limited to straps provided with hook and loop fasteners, cravats, tape or other fixture means. FIG. 1 is an example of a conventional prior art spine board 10 having an array of elongated handhold openings 12 spaced about the peripheral edge of the board. These handhold opening 12 serve the dual purpose of handholds for physically manipulating the board as well as providing apertures through which straps S (also shown, for example, in the inventive embodiment shown in FIG. 3) may be passed for securing a patient to the board.

Regardless of the method used to secure the patients head to the board, preparing the patient for transport on the conventional spine board typically requires an additional step of taping the head in two places, or otherwise securing the head onto the spine board. To accomplish this, depending on how the head was secured to the board, the board holding the patient might need to first be lifted off its resting surface enough to either pass the attachment straps or adhesive tape under and around the board, or around and through the slots. To pass tape or other securing means under the board will require the lifting of the board and patient. The process of lifting the board to secure a patient can be difficult and time consuming, and possibly dangerous especially when the board is on an unstable surface, or a surface such as grass, dirt, snow, ice, mud or the like because it requires extra personnel that may not be available, or, diluting the efforts of those already on the scene. The problem is further exacerbated when operating in confined spaces. It is critically important that the patient be properly immobilized on the spine board for transport and equally important that the process is carried out in the most expedient manner possible to ensure the patient is delivered to a medical facility expeditiously, especially if the patient has suffered significant trauma. Any extra time required to secure the patient properly can impede timely delivery to a medical facility, and may naturally have an adverse affect on the patient's prognosis.

When using a conventional spine board, materials that are used to secure the patient's head must be either passed through the handhold openings 12 between front and back sides of the spine board (also shown, for example, in the inventive embodiment shown FIG. 3), wrapped around the board, taped to the board, or in some other way attached to the board to secure the patient's body to the spine board. Because both ends of each and all the handles are integrated into the spine board, a pre-formed loop at one end of a loop-end strap cannot be attached to the handle.

The last step is to secure to the spine board the head immobilizer (whatever method is used) and the cervical collar. The head immobilizer with the head sandwiched therein is secured about the forehead and also about the chin of the patient to the spine board. The patient, the head immobilizer, and the cervical collar are then secured to the spine board (making a "single mechanical unit"). This is usually done by wrapping adhesive tape completely around the spine board the head immobilizer, the cervical collar, and the spine board with or by using pre-manufactured straps with hook-and-loop fasteners at each end.

Conventional spine boards typically require lifting the spine board with the patient thereon off the ground again to wrap the head of the patient to the board using, for example, adhesive table. The head end of the spine board with the patient secured thereon is lifted off the ground so that several rotations of adhesive tape can be wrapped around the head of the patient to securely secure the head of the patient to the board. This activity, where the board is lifted with the patient so that the adhesive tape can be brought under the board further delays rescue and provides additional opportunity for slips and falls. Furthermore, if adhesive tapes are used to secure the patient, tape is extremely difficult to handle while wearing BSI (body substance isolation) gloves or anything on the hands, and hook-and-loop fasteners may fail due to dirt, snow, ice, grass, or other debris at the accident site. Also, handling adhesive tape is time consuming and difficult to handle and is rendered ineffective or worse in the rain and snow, or at a dark accident site.

Further, since conventional spine boards have head area handhold openings and body area handhold opening disposed at predetermined and fixed positions, it may also be difficult to accommodate differently sized patients, for example, to secure a small-size patient, such as, a three-feet-tall child, to a spine board made for a full-size patient, such averaged size adult about five feet ten inches tall, or vice versa.

SUMMARY OF THE INVENTION

Accordingly, the present invention is set to overcome the above-described drawbacks of the prior attempts. An object of the present invention is to provide a spine board system which includes a spine board; at least one cleat being positioned on a longitudinal edge of the spine board and having a proximal end coupled to the spine board, and a distal end disposed away from the spine board and formed in a hook shape. In accordance with the present invention, straps, cordage, tape, cravats or many other methods can be quickly attached to the cleat to secure to the spine board, the head of a patient placed on the spine board, the head immobilizer placed at the sides of the head, and a cervical collar wrapped around the neck of the patient. The patient is secured to the spine board without having to lift the spine board off the ground the spine board with the patient laying thereon. In accordance with the present invention, a patient can be quickly secured to a spine board in any weather or ambient light conditions, and the securing means can even be attached to the spine board by feel.

Another object of the present invention is to provide a spine board system suitable for fast securing a patient of different sizes thereon. The spine board system comprises a spine board and at least one cleat positioned adjustably along a longitudinal edge of the spine board and having a proximal end coupled to the spine board, A distal end disposed away from the spine board and formed in a hook shape, so that straps can be quickly attached to the cleat to secure to the spine board all of the head of a patient placed on the spine board, a head immobilizer placed at the sides of the head, and a cervical collar wrapped around the neck of the patient, without having to lift off the ground the spine board with the patient thereon. The cleat is coupled to a groove extending along a longitudinal edge of the spine board and positioned adjustably along the groove.

Another object of the present invention is to provide a retrofittable cleat array for a spine board. The cleat array includes a top plate. A cleat support structure is fixed to the top plate and defines a gap. At least one cleat is supported in the gap by the cleat support structure. In accordance with this aspect of the invention, the top plate, the cleat support structure and the cleat are configured and dimensioned so that the cleat support structure and the cleat are insertable into a through-slot in a pre-existing board. The top plate is configured and dimensioned to enable the cleat support structure to be retained in the through-slot. The cleat is further configured and dimensioned to receive and retain a flexible securing member, such as a strap, used for securing a patient to the board.

BRIEF DESCRIPTION OF THE DRAWINGS

The accompanying drawings, which are incorporated in and constitute a part of this specification, illustrate certain aspects of the invention and together with the description, serve to explain, without limitation, the principles of the invention. Like reference characters used herein indicate like parts throughout the several drawings.

DETAILED DESCRIPTION OF THE INVENTION

The present invention can be understood more readily by reference to the following detailed description, examples, and drawings, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

The present invention may be understood more readily by reference to the following detailed description of preferred embodiments of the invention and the examples included therein and to the Figures and their following description.

Figure 1:
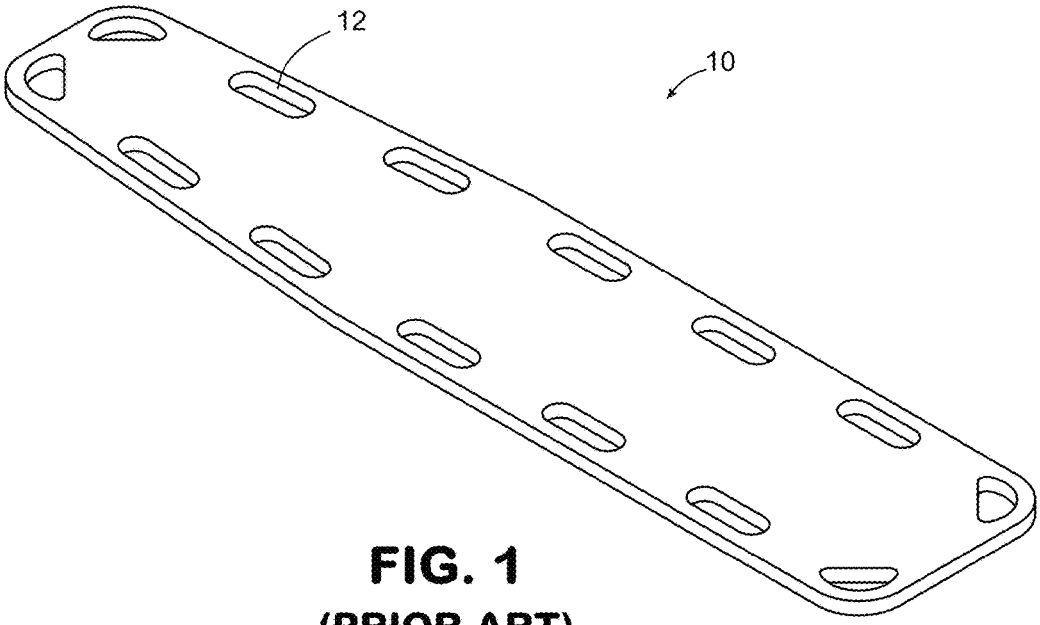
FIG. 1 (PRIOR ART)
FIG. 1 is a perspective view of a typical prior art spine board.
Figure 2:
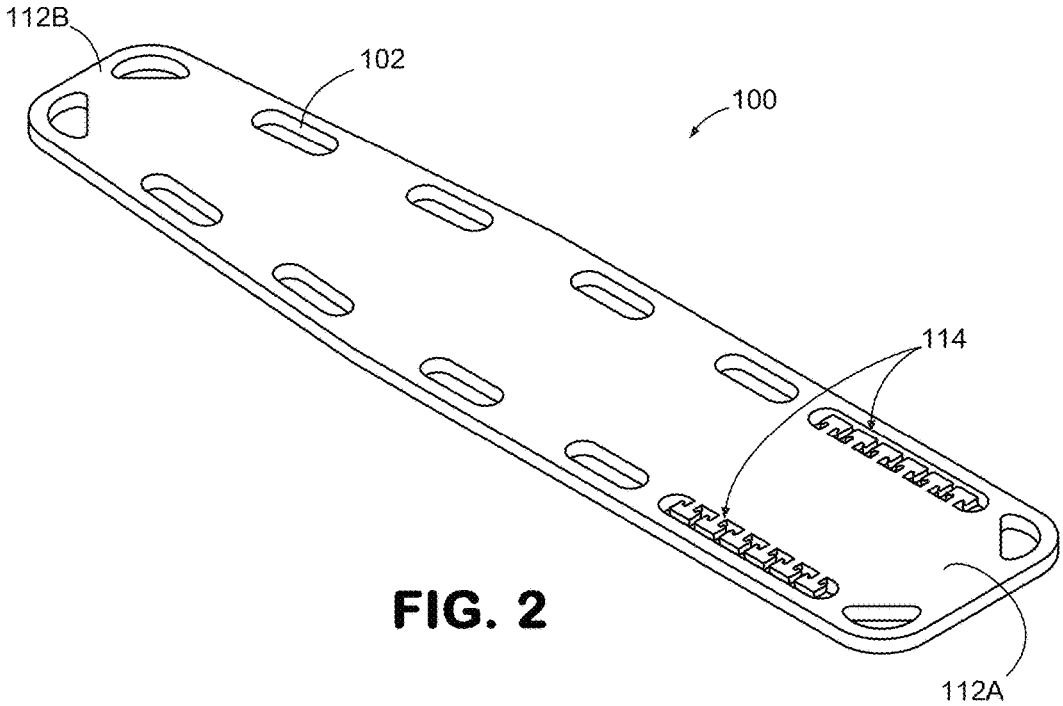
FIG. 2 is a perspective view, similar to FIG. 1, and showing a first embodiment of the spine board with an improved securing means.
Figure 3:
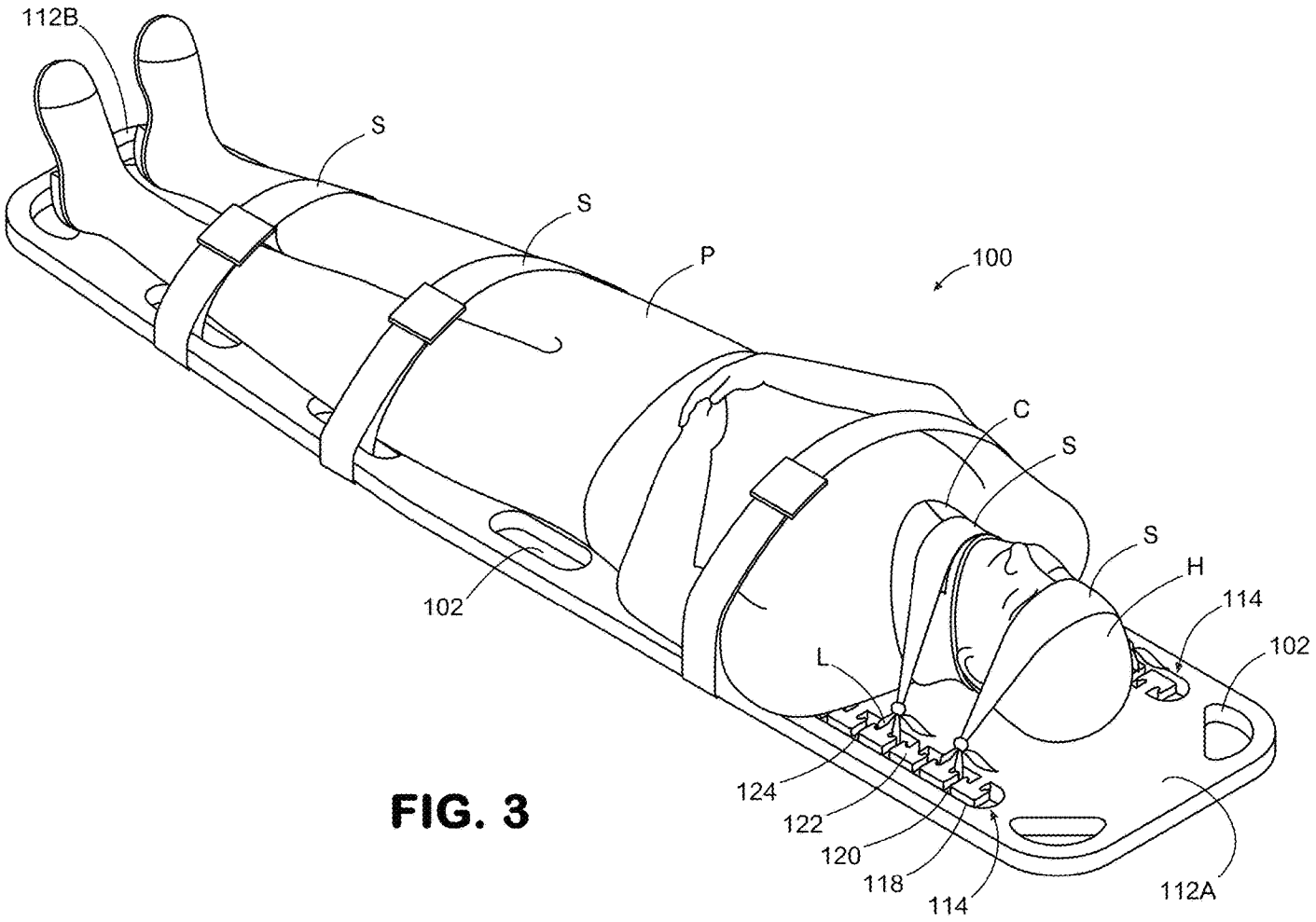
FIG. 3 is the perspective of FIG. 2 and showing a patient secured to the board with restraints attached to the improved securing means.
Figure 4:
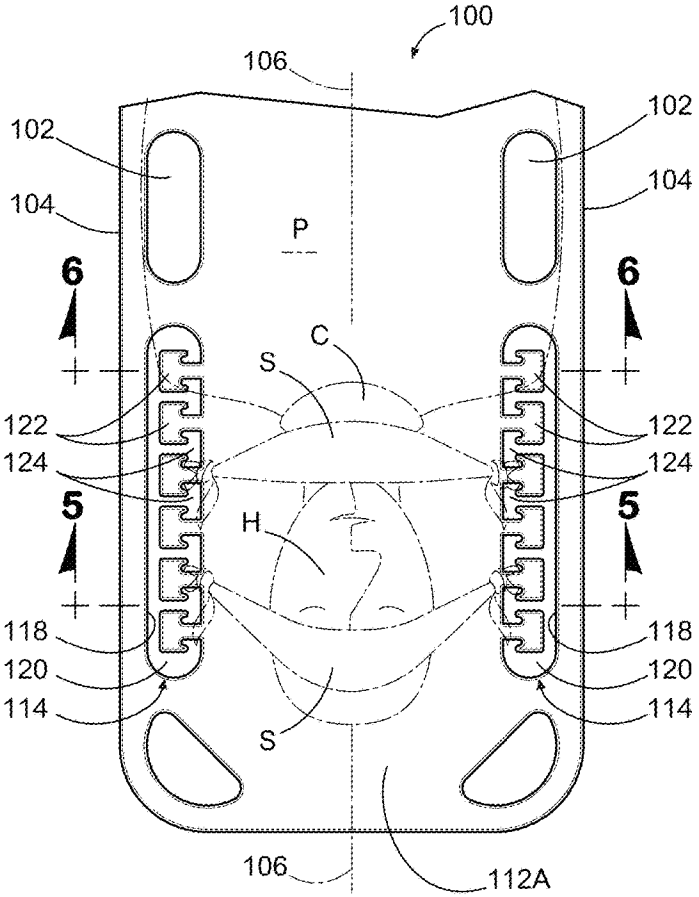
FIG. 4 is a fragmentary top plan of the head portion of the spine board shown in FIG. 3 with the patient thereon illustrated in phantom lines.

Referring now to FIGS. 2-4, in accordance with an embodiment of the inventive spine board, a board 100 is provided sharing similarities with the prior art board 10 shown in FIG. 1 having handholds 102, a head end 112A, a foot end 112B, side board edges 104 and a longitudinal axis 106. In accordance with the inventive spine board, the board 100 is suited with at least one pair of juxtaposed cleat arrays 114 at the head end 112A of the spine board 100. Each juxtaposed cleat array 114 is surrounded by an endless edge 118 that defines a through-hole or through-slot 120 through the board 100. The innermost edge of 118 is suited with a series of substantially "T" shaped cleats 122 spaced apart by complimentary "T" shaped spaces 124. This arrangement of cleats 122 and spaces 124 provides a series of strap entry and anchor points to selectively attach straps S or the like to secure the head H of the patient P wearing a cervical collar C to the board 100.

As shown in FIGS. 2-4, in accordance with the inventive spine board, the board 100 has a longitudinal board edge 104. At least one cleat 122 is positioned adjacent to the longitudinal board edge 104. Each cleat 122 has a proximal end coupled to the board 100, and a distal end disposed opposite the proximal end. The distal end has an engagement member (for example, the cross of the T-shaped cleat 122 shown in FIG. 2-4) configured and dimensioned to receive and retain a flexible securing member, such as strap S, used for securing a body (patient P) to the board 100.

Figure 6:
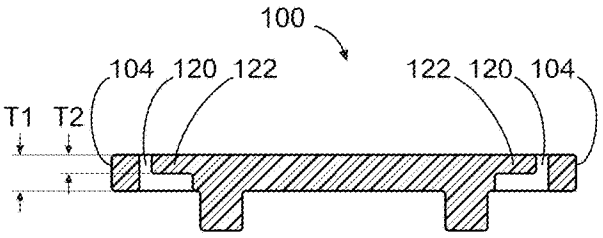
FIG. 6 is a cross-sectional view taken along lines 6-6 in FIG. 4.
Figure 5:
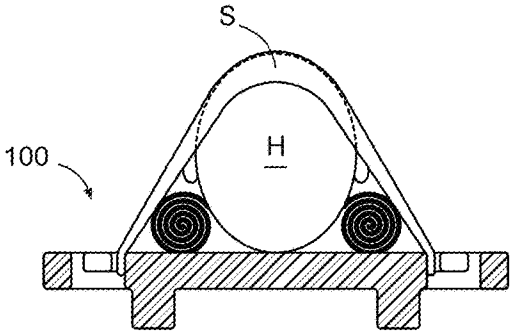
FIG. 5 is a cross-sectional view taken along lines 5-5 in FIG. 4.

With reference to FIGS. 4-6, the cleat array 114 is shown in more detail. Each individual cleat 122 is composed of a post 128 that extends outward toward the side board edges 104, and perpendicular to the long axis 106 of the spine board 100. Each post 128 is connected at the central point of a crossbar 130. The ends of each crossbar 130 are suited with protuberances 132. In operation, the strap S, such as cravats, tape or the like is looped, passed through the board 100, via through-slot 120 and placed around the neck, formed by post 128 of the cleat 122 and then co-joined to form a closed loop L around the post 128. The crossbars 130 act as stops for any lateral movement along post 128. The protuberances 132 act as stops to further prevent a loop L, especially an enlarged loop, from inadvertently disengaging from the composite cleat 122 formed by post 128 and crossbar 130.

In accordance with an embodiment of the inventive spine board shown in FIGS. 2-6, the board 100 has a board edge 104 and a long axis 106, and defines a through-slot 120 disposed in the board 100 adjacent to the board edge 104 and parallel to the long axis 106. One or more cleats 122 may comprise a post 128 extending outward from the interior of the board 100 toward the board edge 104 and perpendicular to the long axis 106. Each cleat 122 is configured and dimensioned for selectively attaching securing means (for example, strap S) to secure a patient P to the board 100. The cleat may comprise the post 128 may be connected to a crossbar (for example, the cross of the T-shaped cleat 122) configured and dimensioned to prevent the securing means from slipping off the cleat 122.

As seen more clearly in cross-section views 5 and 6, spine boards are normally suited with longitudinal ribs R that serve to provide structural strength, dispose the board slightly above its resting surface in order to pass straps S through the through-slots 120 and provide space for hands to gain access to the through-slots 120 to manipulate the board 100 with patient P thereon. In accordance with an exemplary embodiment, the cleat 122 may be of reduced thickness T2 relative the spine board thickness T1. This reduced thickness T2 of cleat 122 enables the loop L to be easily passed through the board 100 even if the board is resting on a soft surface such as snow, grass, or the like, where the resting surface may be in close proximity to, or in actual contact with, the bottom of the board 100.

Figure 7:
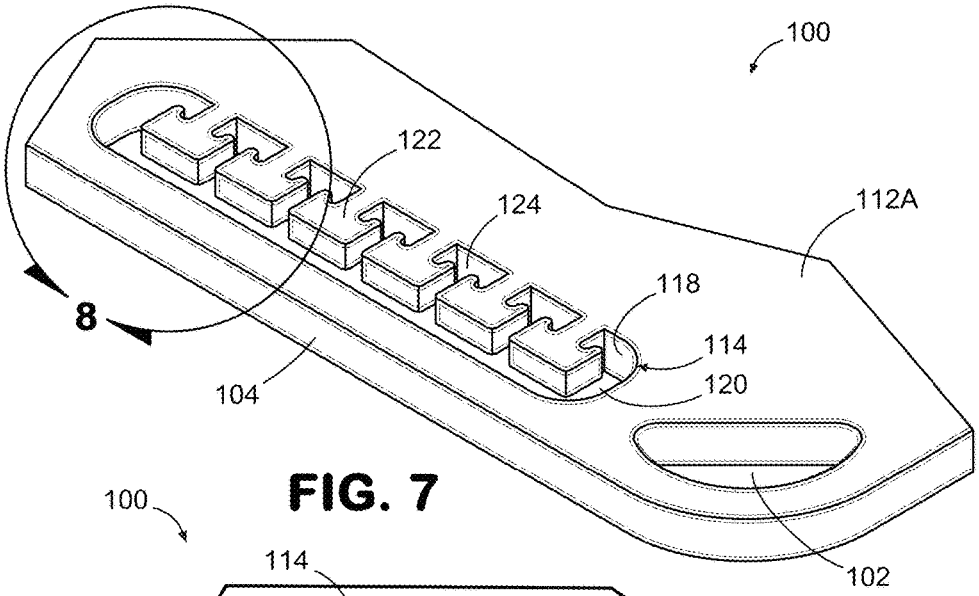
FIG. 7 is a perspective view of a fragmentary portion of the spine board shown in FIGS. 2-6.
Figure 8:
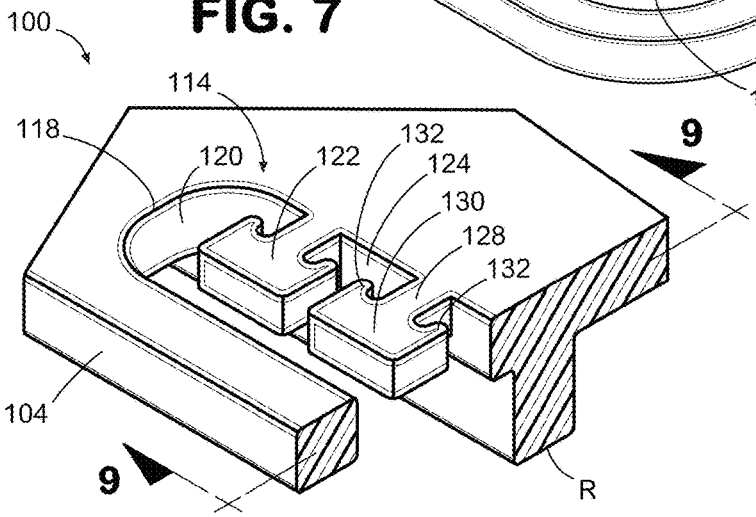
FIG. 8 is an enlarged fragmentary section view taken at inset circle 8 in FIG. 7.
Figure 9:
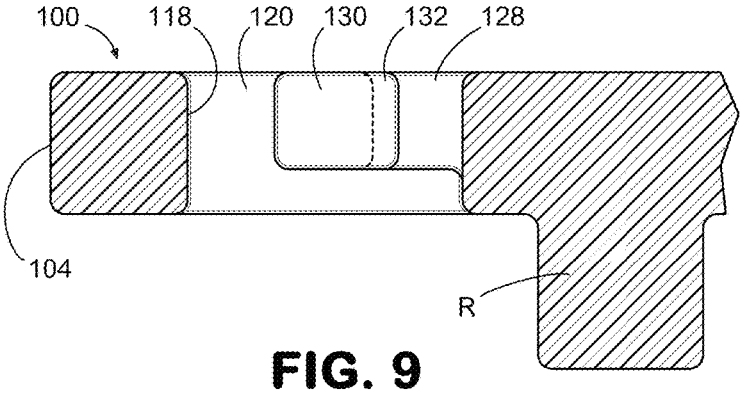
FIG. 9 is a cross-sectional view taken at lines 9-9 in FIG. 8.

FIGS. 7, 8 and 9 are views that are enlarged for clarity of this exemplary embodiment. As shown, the board 100 has a board thickness T1, and the cleat 122 has a cleat thickness T2 that is less than the board thickness T1 to facilitate the attachment of the securing means (for example, straps S).

For purposes of illustration, the following alternate embodiments illustrated in FIGS. 10 through 23 will show only a fragment of one cleat array, the mirror image of which, as shown and described herein with reference to FIGS. 2-9, is not shown.

Figure 10:
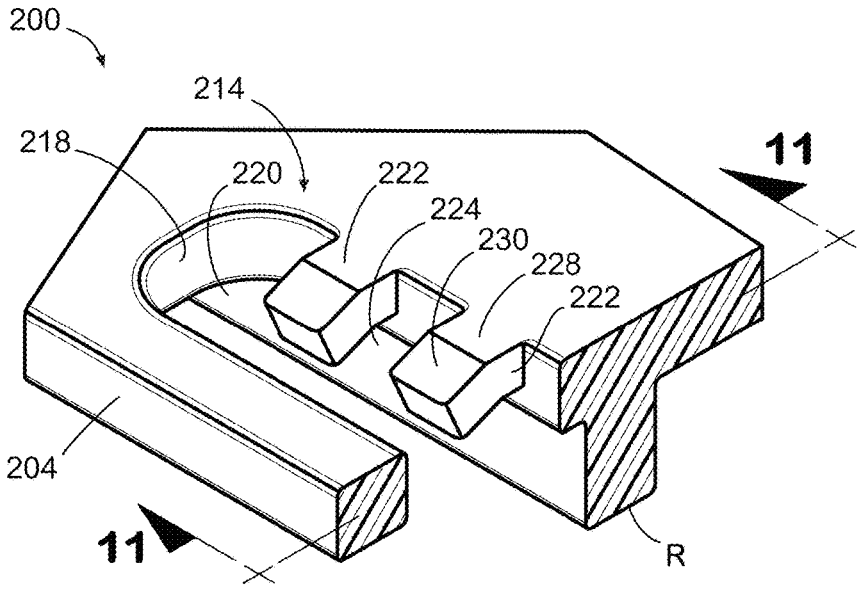
FIG. 10 is a perspective view of a fragmentary portion of the spine board showing an alternate embodiment of the attachment cleats.
Figure 11:
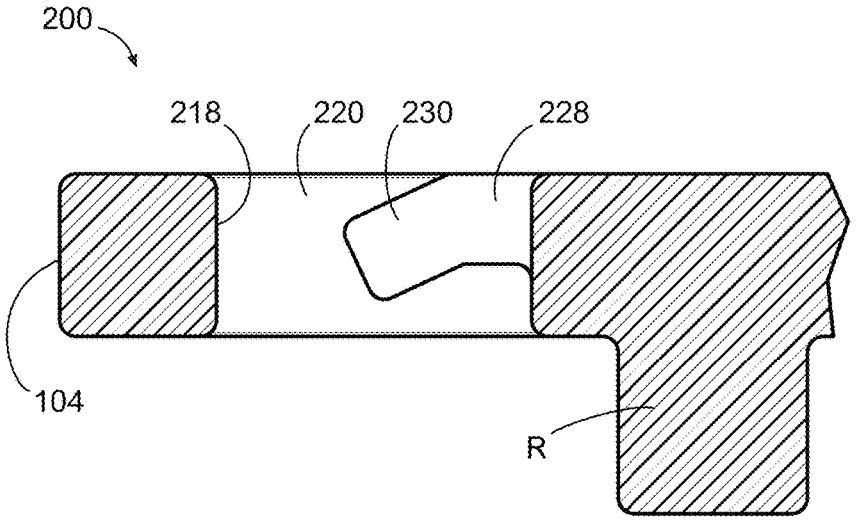
FIG. 11 is a cross-sectional view taken along lines 11-11 in FIG. 10.

FIGS. 10 and 11 show a fragmentary portion of a second embodiment of a spine board 200 having a cleat array 214. Each cleat array 214 is composed of a series of cleats 222 that extend from an inside edge 218, that defines a through-slot 220 through the board 200.

As in the previously described embodiment, this opening through the board provides a passage through which a strap may be passed to loop around the cleat 222. The cleat 222 is composed of a post 228 extending horizontally from inside edge 218 and out toward the side edge 204 of board 200 and then co-joins a downwardly angled prong 230 at its distal end. The composite arrangement of post 228 and angled prong 230 serve to retard the strap loop from inadvertently disengaging from the cleat 222. In accordance with this exemplary embodiment, the post 228 of the cleat 222 terminates in a downwardly angled prong 230 disposed at a distal end of the post 228 effective to prevent the securing means from unintended disengagement from the cleat 222.

Figure 12:
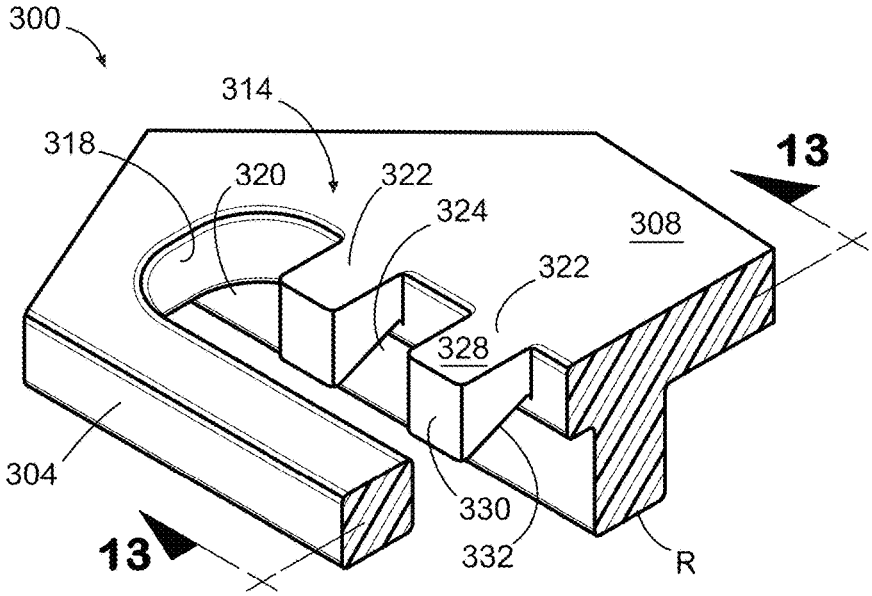
FIG. 12 is a perspective view of a fragmentary portion of the spine board showing another alternate embodiment of the attachment cleats.
Figure 13:
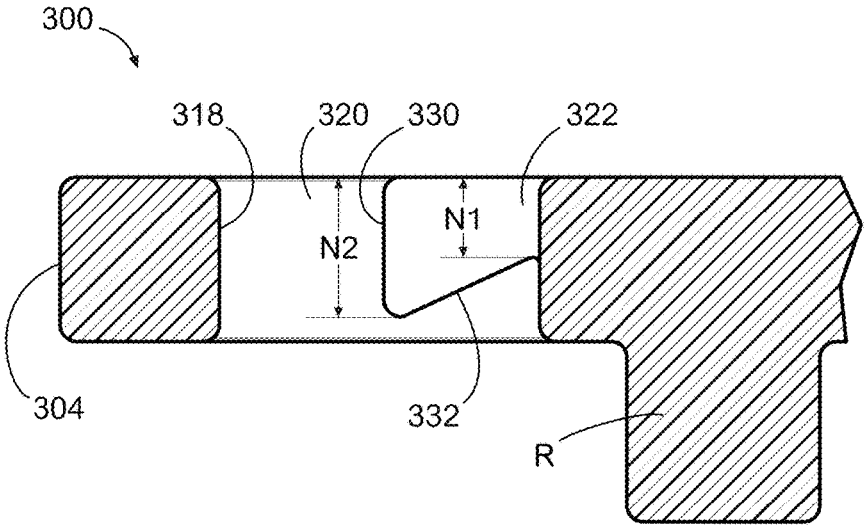
FIG. 13 is a cross-sectional view taken along lines 13-13 in FIG. 12.

FIGS. 12 and 13 show a fragmentary portion of a third embodiment of a spine board 300 having a cleat array 314. Each cleat array 314 is composed of a series of individual cleats 322 that extend from an inside edge 318, that defines a through-slot 320 through the board 300. The cleat 322 has a top surface 328 that extends from, and is co-planar with, the top surface 308 of the board 300 and terminates in an end 330 that is perpendicular to the top surface 328 of cleat 322. End 330 connects to an angled bottom 332 that re-joins annular edge 318 to form a truncated triangular shape. The geometry of cleat 322 provides a reduced neck portion shown as dimension N1 at its juncture with edge 318 and an enlarged end portion shown as dimension N2 within the margin of through-slot 320. Subsequently, when the loop of a strap is tightened around the narrow neck of a cleat 322, the enlarged end 330 serves to prevent the loop from inadvertently disengaging from the cleat 322.

In accordance with this exemplary embodiment, the board 300 has a board top surface 308. The cleat 322 has a cleat top surface 328 extending from and substantially co-planar with the board top surface 308. The cleat 322 terminates in a terminating end 330 that is perpendicular to the cleat top surface 308. The terminating end 330 is integrally formed with an angled bottom 332 that re-joins the board 300 forming a substantially truncated triangular shape thereby forming a cleat geometry having a reduced neck portion N1 extending from the board edge and an enlarged end portion N2 disposed within the through-slot 320.

Figure 14:
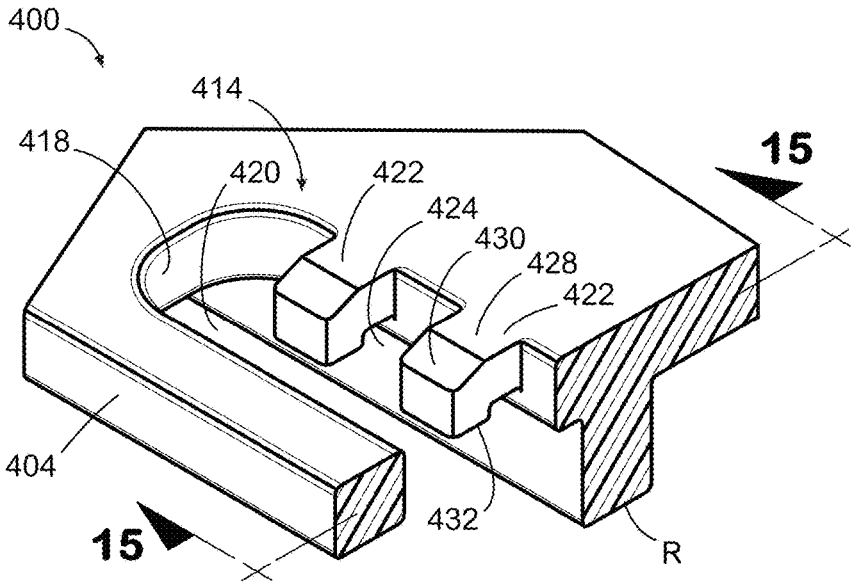
FIG. 14 is a perspective view of a fragmentary portion of the spine board showing a further alternate embodiment of the attachment cleats.
Figure 15:
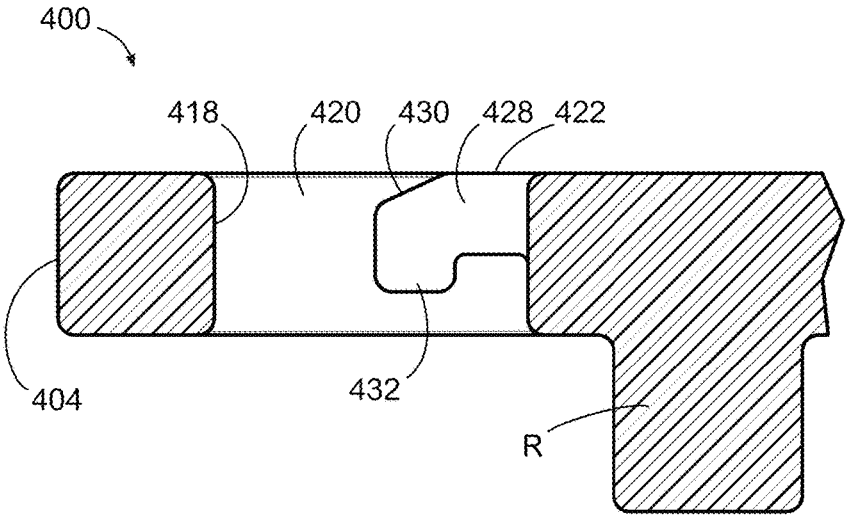
FIG. 15 is a cross-sectional view taken along lines 15-15 in FIG. 14.

Referring now to FIGS. 14 and 15, a fragmentary portion of a fourth embodiment of a spine board 400 with a cleat array 414 is shown. This embodiment is similar to the second embodiment with a post 428 extending from an edge 418 defining a through-slot 420 through the board 400 and an angled prong 430. The prong 430 is detailed with a downwardly extending protrusion 432 to further inhibit the loop of the strap from disengaging from first neck portion defined by post 428 of cleat 422.

Figure 16:
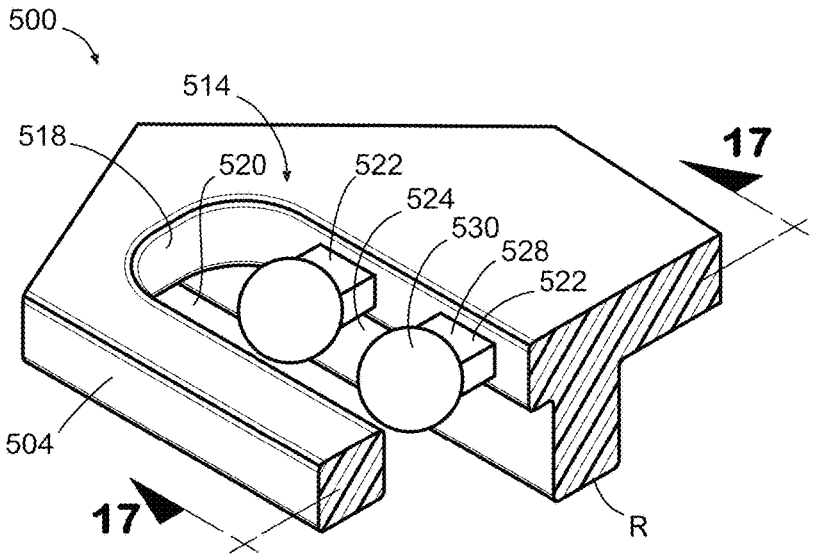
FIG. 16 is a perspective view of a fragmentary portion of the spine board showing another alternate embodiment of the attachment cleats.
Figure 17:
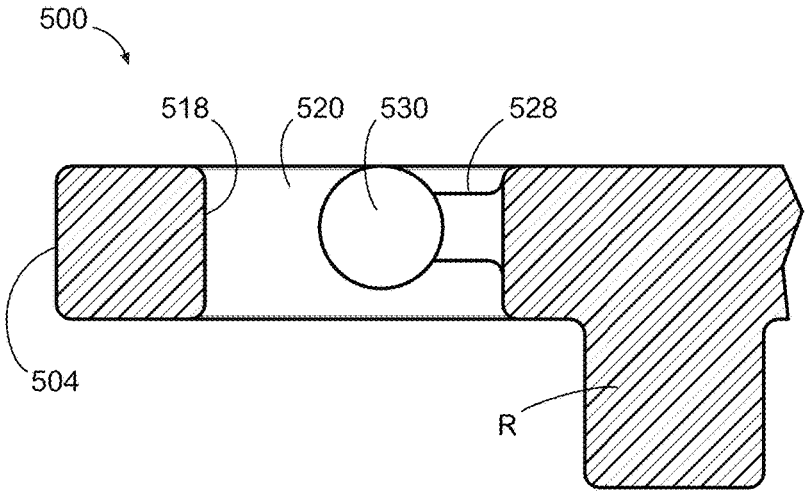
FIG. 17 is a cross-sectional view taken along lines 17-17 in FIG. 16.

A fifth embodiment of a spine board 500 is shown in FIGS. 16 and 17 having a cleat array 514. The cleat array 514 is suited with a post 528 extending from an edge 518 defining a through-slot 520. The post 528 terminates in bulbous end portion 530. It will be appreciated that the reduced cross-sectional area of the neck portion defined by post 528 in combination with the increased cross-sectional area of the bulbous end portion 530 serve to inhibit the loop of the strap from disengaging from the post 528 of cleat 522.

In accordance with this exemplary embodiment, the protrusion defines a bulbous portion 530 with a reduced cross-sectional area of the post 528 relative to an increased cross-sectional area of the bulbous end portion 530 inhibit the securing means from disengaging from the cleat 522.

Figure 18:
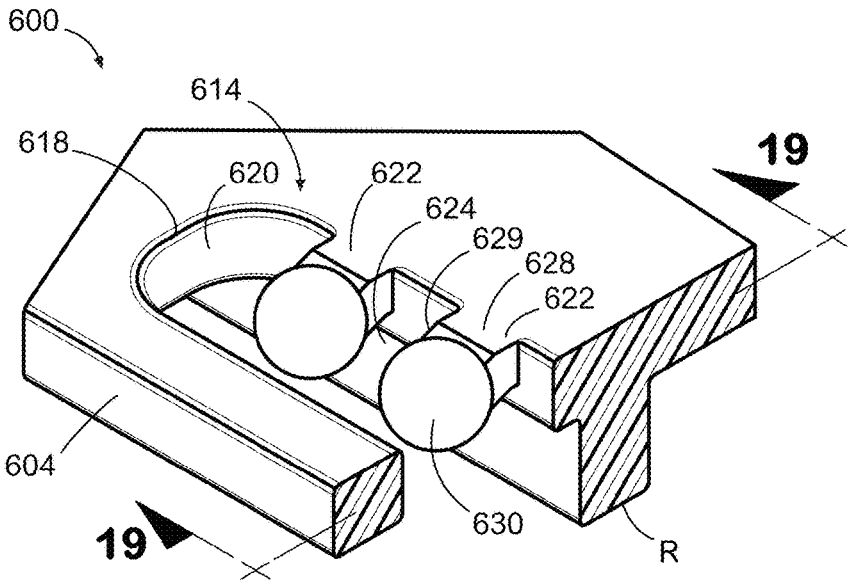
FIG. 18 is a perspective view of a fragmentary portion of the spine board showing still another alternate embodiment of the attachment cleats.
Figure 19:
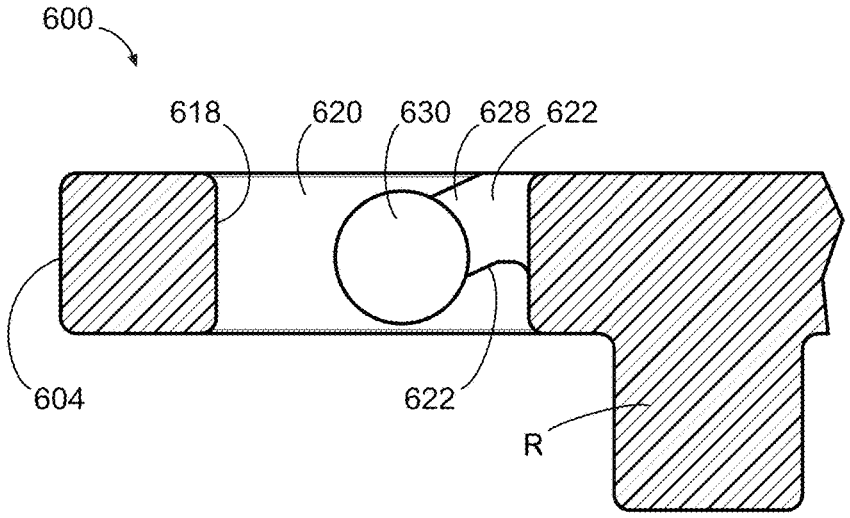
FIG. 19 is a cross-sectional view taken along lines 19-19 in FIG. 18.

As shown in FIGS. 18 and 19, a sixth embodiment is disclosed showing a spine board 600 with cleat array 614 similar in construction to the disclosure of board of 500. The cleat array 614 comprises a composite assembly of post 628, a downwardly angled prong 629 and a bulbous portion 630. As in the previously described advantage of cleat 514 on spine board 500, this downwardly angled cleat 614 serves to further retard and inhibit the loop of a strap from inadvertently disengaging from the post 628 of cleat 622.

The cleat arrays of previously described embodiments, up to this point, have one piece designs that could be cast, molded or otherwise manufactured to produce an improved spine board according to the principles of the present invention. The following embodiments shown in FIGS. 20 through 26 are suited with articulated cleats, for example, journaled within interior slots.

Figure 20:
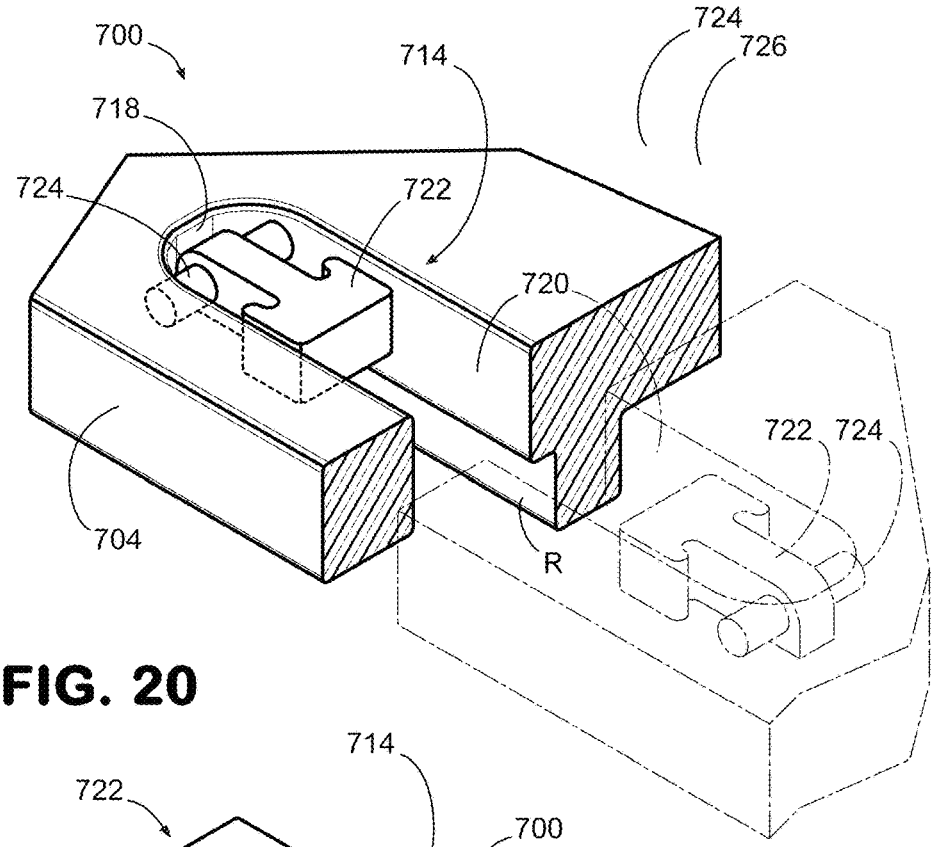
FIG. 20 is a perspective view of a fragmentary portion of the spine board showing a still further alternate embodiment of the attachment cleats in the down or stored position that is journaled for rotation about an axle that is oriented perpendicular to the long axis of the spine board.
Figure 21:
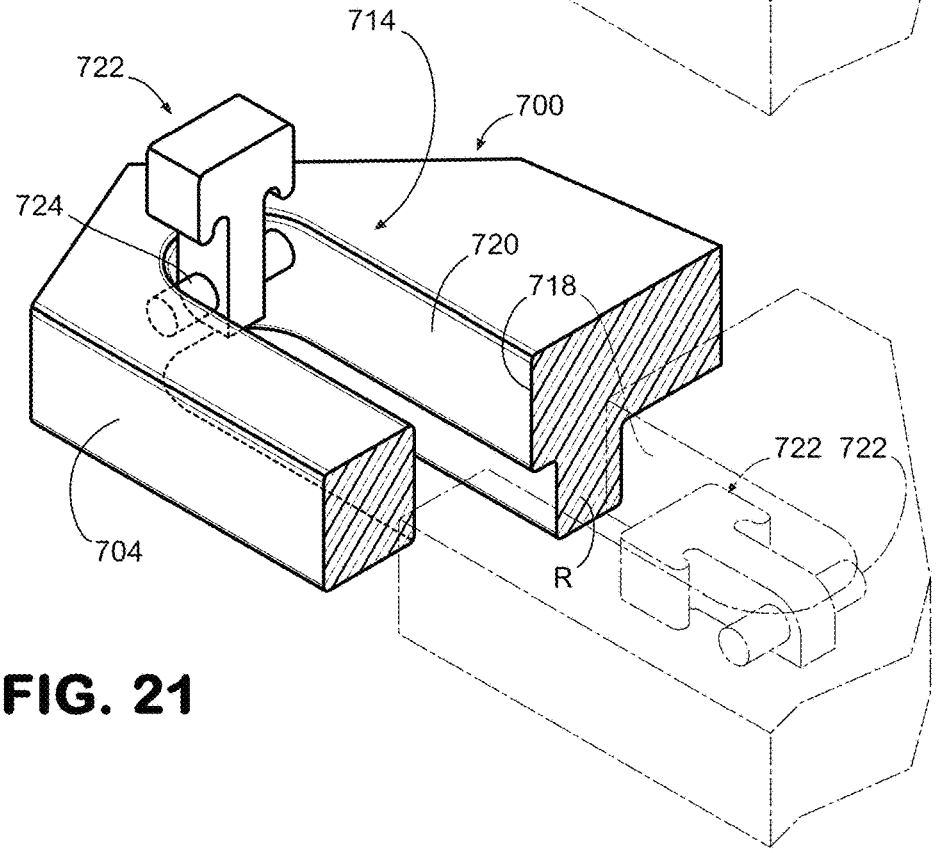
FIG. 21 is a perspective view, similar to FIG. 20, showing the articulated cleat in the up position and ready for attachment of restraints.

FIGS. 20 and 21 show a seventh alternate embodiment having a spine board 700 with an elongated through-slot or through-slot 720 through board 700 defined by edge 718. Cleats 722, similar to the geometry and structure of cleat 22, shown and described in FIGS. 2 through 9, are journaled within the through-slot 720 for rotation about an axle 724 oriented perpendicularly to the long axis of the spine board 700. FIGS. 20 and 21 show a pair of cleats, one at each end of the through-slot 720. FIG. 20 shows a cleat 722 in a down and stored position and FIG. 21 shows a cleat in an up and ready position for securing a patient to the board 700.

In accordance with this exemplary embodiment, each cleat 722 is journaled within the through-slot 720 for rotation about a cleat axle 724 oriented substantially perpendicular to the long axis of the board 700 so that the cleat 722 can be rotated into a stored position (FIG. 20) and rotated into a ready position (FIG. 21).

Figure 22:
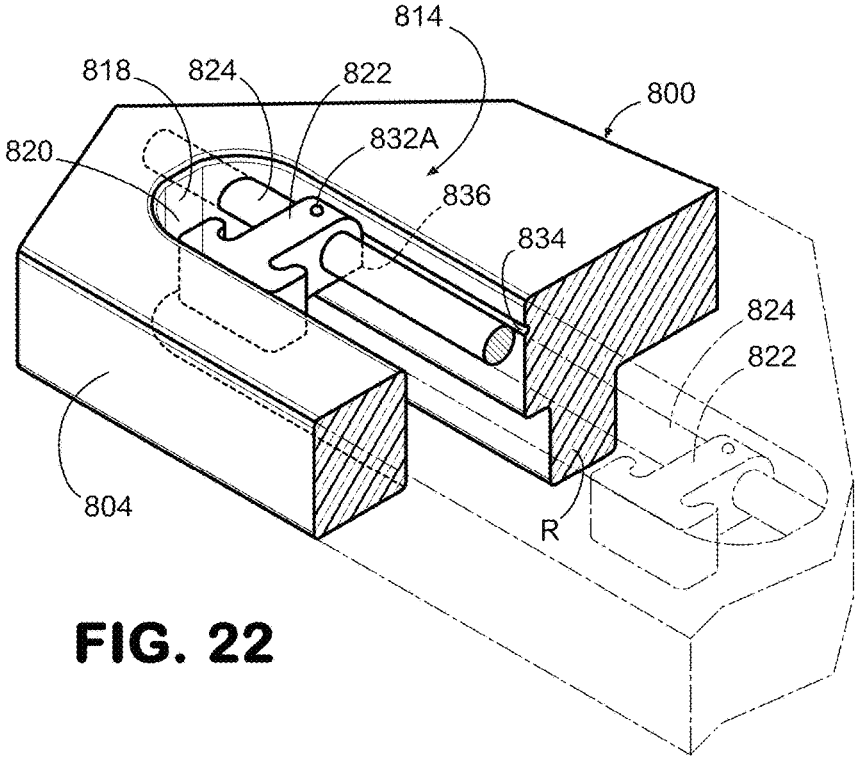
FIG. 22 is a perspective view of a fragmentary portion of a spine board and showing a final alternate embodiment of an articulated cleat in the down and stored position that is journaled for rotation about an axle that is oriented in alignment with the long axis of the spine board.
Figure 23:
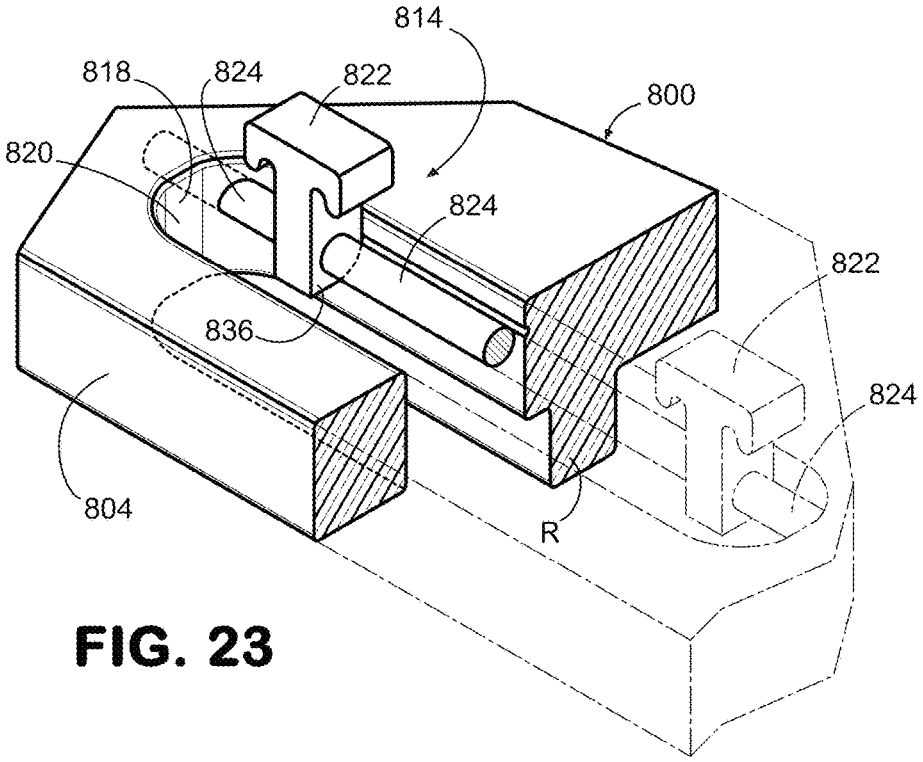
FIG. 23 is a perspective view, similar to FIG. 22, showing the articulated cleat in the up position and ready for attachment of restraints.

FIGS. 22 and 23 show an eighth embodiment of a spine board 800, similar to the previously shown embodiment of the inventive spine board 700. In this exemplary embodiment, the inventive spine board 800 is suited with a through-slot 820, defined by edge 818, which forms a passage through the board 800. Within the through-slot 820 is held for rotation at least one cleat 822, similar to cleat 722, on an axle 824. The elongated axle 824 is oriented parallel with the long axis of the board 800 and spans the longitudinal length of the slotted through-slot 820. In operation, this cleat 822 may be positioned anywhere along the axle 824 to provide a variety of positions from which to place anchor points for attachment of straps to secure the patient to the board 800. FIG. 22 shows the cleat 822 in the down and stored position and FIG. 23 shows the cleat 822 in the up and ready position for securing a patient to the spine board 800.

Figure 24:
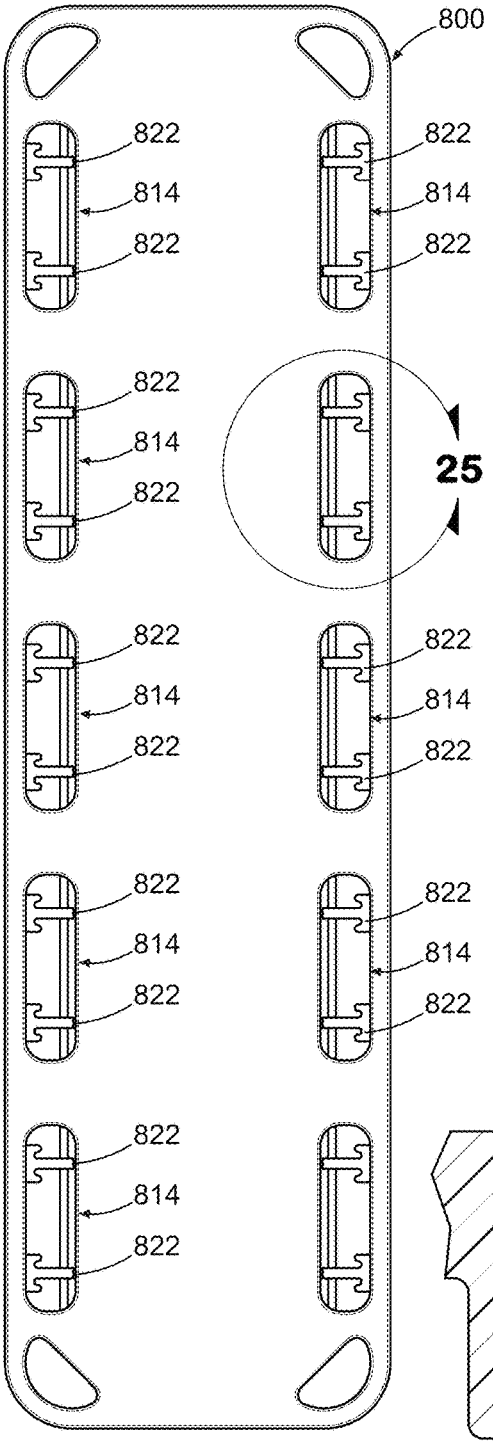
FIG. 24 is a top plan view of a spine board suited with an array of the articulated cleats shown in FIGS. 22 and 23 and surrounding the outer periphery of the spine board.

FIG. 24 shows a spine board 800 detailed with a series of cleat array pairs 814 suited with cleats 822. These juxtaposed pairs of cleat arrays 814 are spaced from head portion 812A to foot portion 812B on spine board 800 so that a patient may be fully secured all along the board with these easily deployed and slidably positionable cleats 822.

Figure 25:
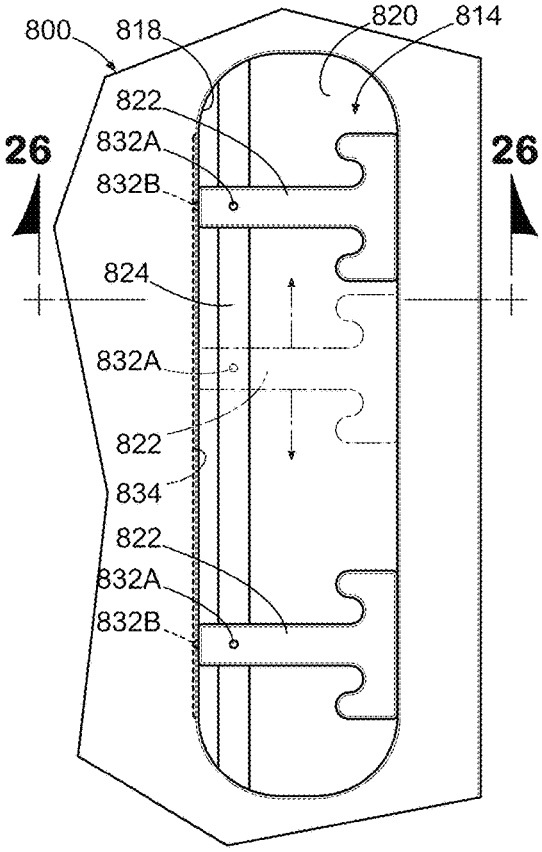
FIG. 25 is an enlarged detail view taken at inset circle 25 in FIG. 24.
Figure 26:
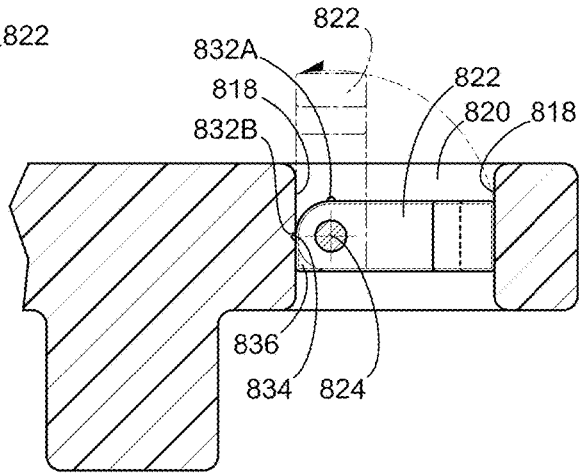
FIG. 26 is a cross-section view taken along lines 26-26 in FIG. 25.

FIG. 25 shows an enlarged detail view of one cleat array 822 in the through-slot 820 defined by edge 818. The axle 824 and cleat journaled thereon is seen more clearly in FIG. 26. The cleat 822 is shown in the down and stored position with a phantom line showing the cleat in the up and ready position for securing a patient to the board 800. In order to maintain the up position of the cleat 822, and arrest its movement once position, a ball 832A formed on cleat 822 is received by within an elongated groove 834 along one side of the side wall of through-slot 820 defined by the edge 818. Additional arrestment of any further downward movement, once the cleat 822 is positioned in the down and stored position, is provided by a right angled corner 836 on bottom of cleat 822 that bears against the inner surface of through-slot 820 defined by the edge 818. Atop the cleat 822, opposite this corner protrusion 836, the cleat is rounded and concentric with axle 824 so that the cleat can be rotated upward without interference. When the cleat is rotated to its most vertical position the ball clicks into the elongated groove 834 to maintain that up position for application of a looped strap.

Referring back to FIG. 25, it should be noted that the through-slot 820 is sufficiently wide enough to accommodate the finger of a gloved hand to reach into the through-slot or through-slot 820 to urge the cleat 822 into the up, operable and ready position for attachment of the strap to secure a patient to the board 800.

In accordance with this exemplary embodiment of the inventive spine board 800, the elongated axle 824 disposed within the through-slot 820 is oriented parallel with the long axis of the board 800 and spans substantially a longitudinal length of the through-slot 820. The cleat 822 is slidably engaged on the elongated axle 824, and two or more cleats 822 may be provided on each elongated axle 824. Additionally, stopping means, such as a clamping mechanism or ratchet mechanism (not shown) my also be provided to fix the cleat 822 on the elongated axle 824 and prevent it from sliding.

Figure 27:
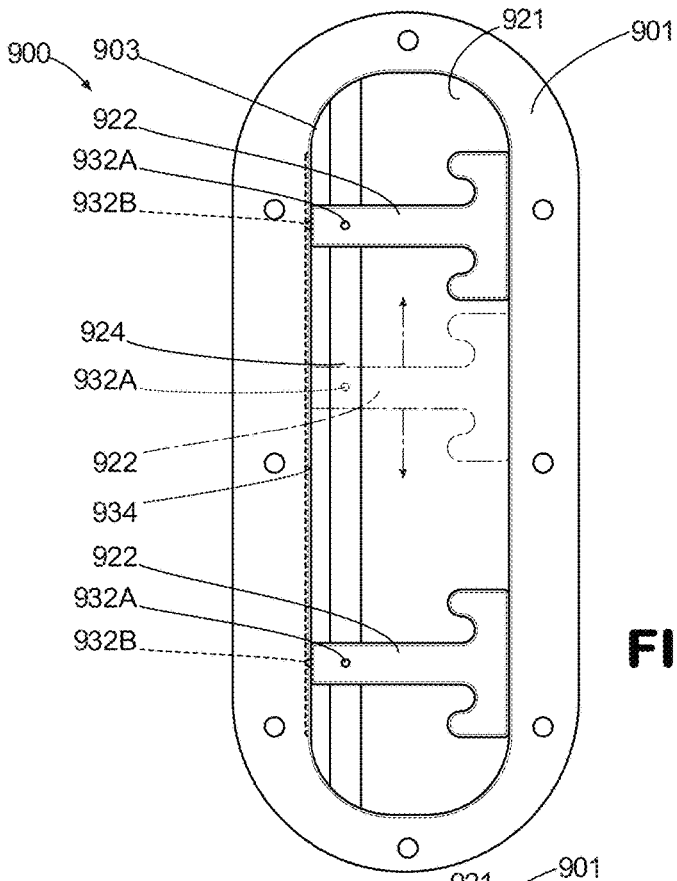
FIG. 27 is a top view of exemplary embodiment of an inventive retrofittable cleat array.
Figure 28:
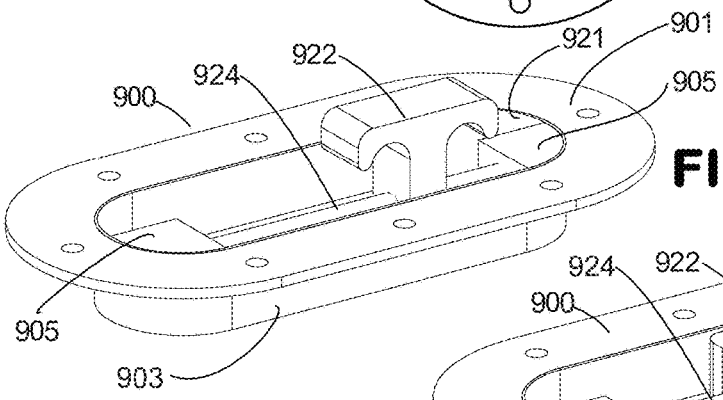
FIG. 28 is a perspective view of the inventive retrofittable cleat array showing the cleat in the up and ready position.
Figure 29:
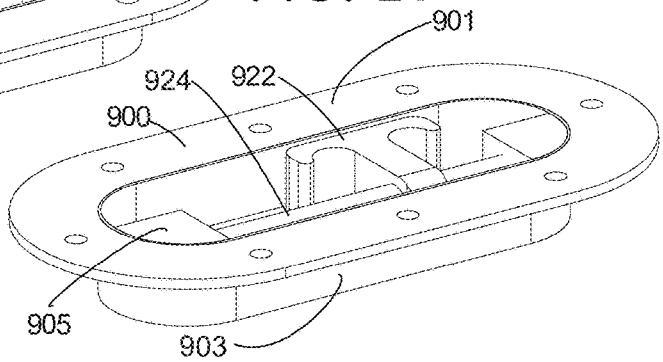
FIG. 29 is a perspective view of the inventive retrofittable cleat array showing the cleat in the down and stowed position.
Figure 30:
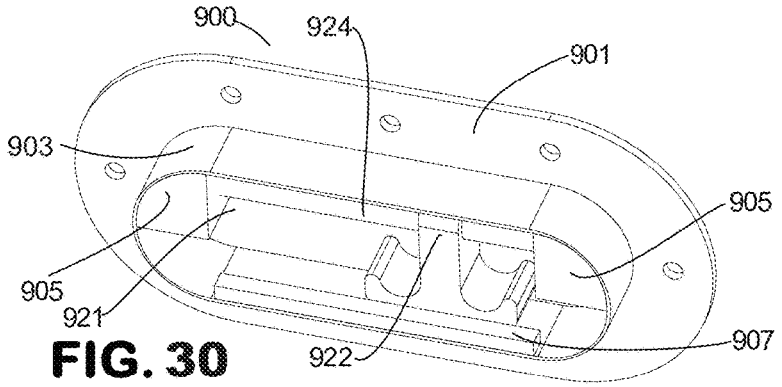
FIG. 30 is a bottom perspective view of the inventive retrofittable cleat array.
Figure 31:
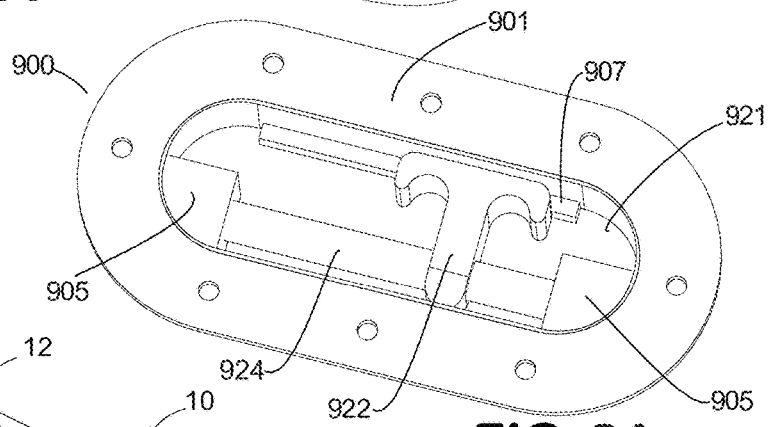
FIG. 31 is a top perspective view of the inventive retrofittable cleat array.
Figure 32:
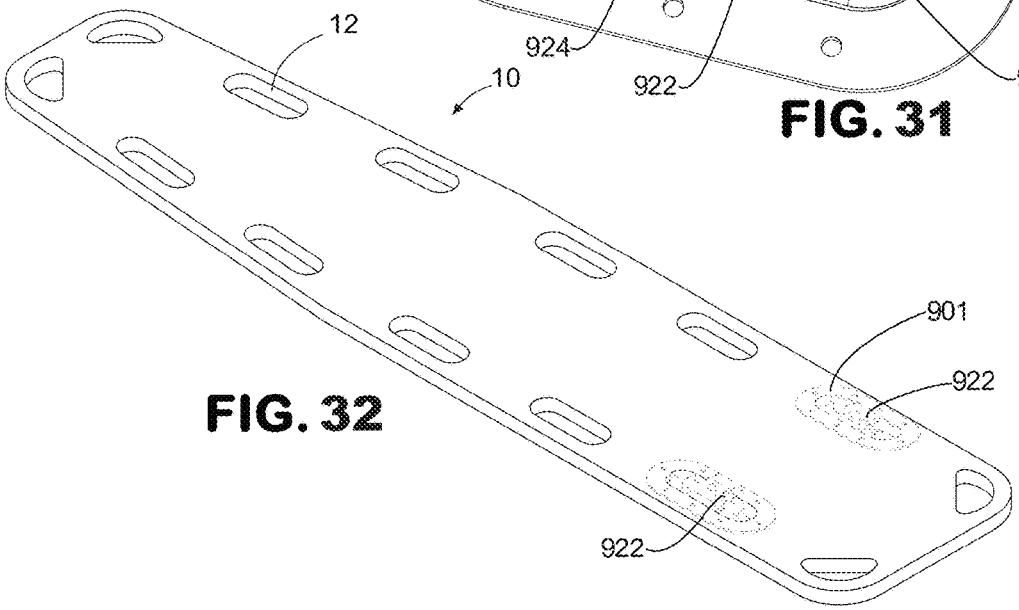
FIG. 32 is a perspective view showing the inventive retrofittable cleat array applied to a conventional spine board.

FIG. 27 is a top view of exemplary embodiment of an inventive retrofittable cleat array. FIG. 28 is a perspective view of the inventive retrofittable cleat array showing the cleat in the up and ready position. FIG. 29 is a perspective view of the inventive retrofittable cleat array showing the cleat in the down and stowed position. FIG. 30 is a bottom perspective view of the inventive retrofittable cleat array. FIG. 31 is a top perspective view of the inventive retrofittable cleat array. FIG. 32 is a perspective view showing the inventive retrofittable cleat array applied to a conventional spine board. In accordance with another aspect of the present invention, a retrofittable cleat array 900 is provided for a spine board 10 (shown, for example, in FIG. 32). The cleat array 900 includes a top plate 901. A cleat support structure 903 is fixed to the top plate 901 and defines a gap 921. At least one cleat 922 is supported in the gap 921 by the cleat support structure 903. In accordance with this aspect of the invention, the top plate 901, the cleat support structure 903 and the cleat 922 are configured and dimensioned so that the cleat support structure 903 and the cleat 922 are insertable into a though-slot (e.g., handhold 12) in a pre-existing board 10 (shown in FIG. 32). The top plate 901 is configured and dimensioned to enable the cleat support structure 903 to be retained in the though-slot 920. The cleat 922 is further configured and dimensioned to receive and retain a flexible securing member, such as a strap, used for securing a patient to the board 10.

The cleat support structure 903 has a cleat support long axis. Similar to other embodiments described herein (for example, FIGS. 2-19), the cleat 922 may comprises a post extending outward the cleat support structure 903 and perpendicular to the cleat support long axis. The cleat 922 is configured and dimensioned for selectively attaching securing means (e.g., strap S) to secure a patient to the board. Various configurations of the cleat 922 described herein, and others, may be incorporated into this inventive retrofittable cleat array 900.

In accordance with an exemplary embodiment, at least one cleat 922 having a proximal end and a distal end disposed opposite the proximal end is supported by the cleat support structure 903. The distal end of the cleat has an engagement member configured and dimensioned to receive and retain the flexible securing member (e.g., the strap S). Adjustment means may be provided for adjusting at least one of a location, angle and rotation of said at least one cleat relative to the board. Similar, for example, to the embodiment shown in FIG. 20-21, the cleat 922 may be journaled within the gap 921 for rotation about an axle oriented perpendicularly to the long axis of the cleat support structure 903.

In accordance with a non-limiting exemplary embodiment, the adjusting means may comprise an elongated axle 924 disposed within the gap 921. The elongated axle 924 is oriented parallel with the cleat support long axis and spans substantially a longitudinal length of the cleat support structure 903. The cleat support structure 903 supports the elongated axle 924, which in turn supports the cleat 922. The cleat 922 may be slidably engaged at the proximal end on the elongated axle 924.

In use, the cleat support structure 903 can be inserted into a though-slot 920 on a pre-existing spine board 10. The top plate 901 may be glued to the top surface of the board, and/or screws of other fixing means used to fix the top plate 901 to the board. The cleat support structure 903 may have one or more cleats 922 integrally fixed to it (similar to the embodiments shown in FIGS. 2-21, but instead of being directly fixed or supported by the board, in this retrofit cleat array, the cleat support structure 903 provides the support to the cleats. In the embodiment shown in FIG. 27-32, the cleat support structure 903 may include support blocks 905 that supports the elongated axle 924, which in turn supports the cleat 922. A cleat stop 907 may also be provided to support the cleat 922 when in the stowed position.

In accordance with the inventive retrofittable cleat array 900, a pre-existing spine board 10 can be retrofitted with the advantages of the inventive aspects described herein. Conventional spine boards may be made from a variety of manufacturing techniques and materials. For example injection or blow molded plastic spine boards are known, an may have handholds on the order of 6" to 10" long and 1" to 2" wide. Other dimensions for the handholds are of course possible, the geometry of the handholds can include, for example, flat, curved or beveled edges. The inventive retrofittable cleat array can be configured and dimensioned to accommodate the specific geometry of a particular preexisting spine board, and the dimensions shown in the drawings and described herein are intended to be non-limiting examples.

Figure 33:
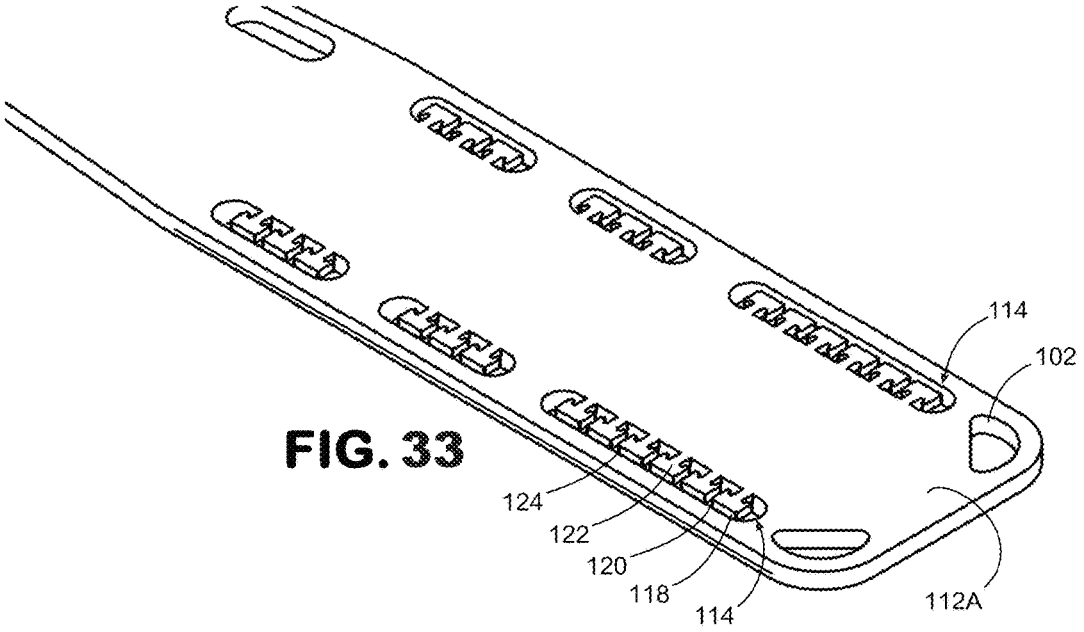
FIG. 33 is a perspective view illustrating the inventive spine board showing multiple instances of the inventive cleat array positioned on the spine board for securing the torso, head and neck of a patient.
Figure 34:
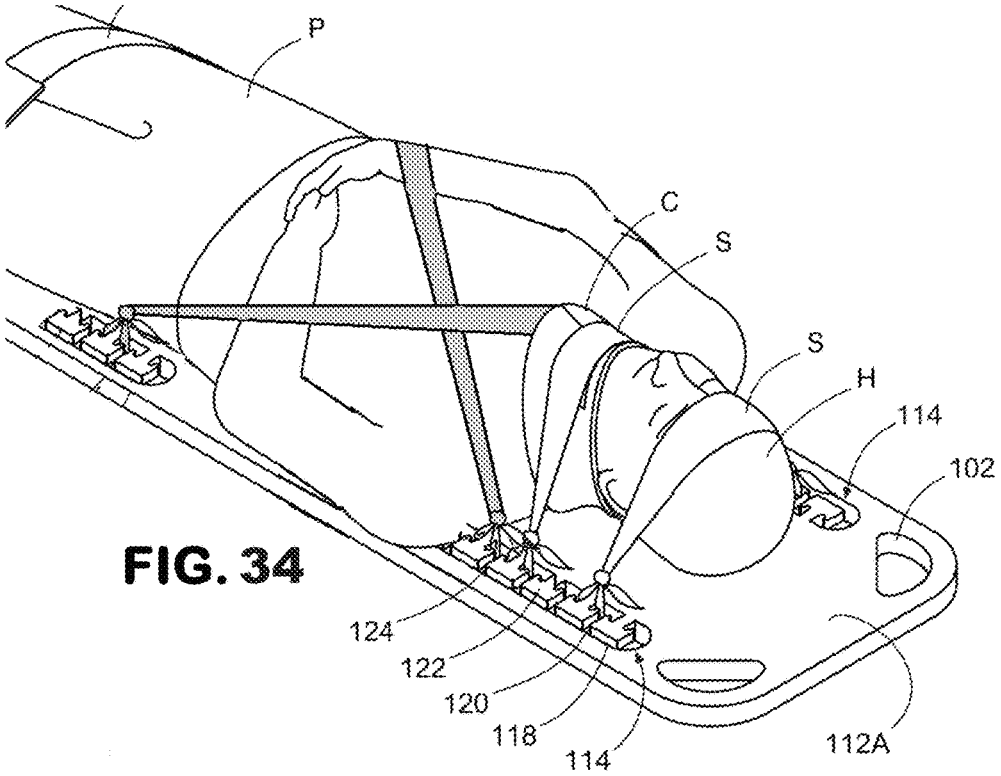
FIG. 34 is a perspective view illustrating the inventive spine board showing the torso, head and neck of a patient secured by straps engaged with inventive cleat array.

FIG. 33 is a perspective view illustrating the inventive spine board 100 showing multiple instances of the inventive cleat arrays 114 positioned on the spine board 100 for securing the torso, head and neck of a patient. FIG. 34 is a perspective view illustrating the inventive spine board 100 showing the torso, head and neck of a patient secured by straps engaged with the inventive cleat arrays 114. As shown in FIGS. 33-34, in accordance with an embodiment of the inventive spine board 100, a board 100 is provided sharing similarities with the prior art board 10 shown in FIG. 1 having handholds 102, a head end 112A, a foot end 112B, side board edges 104 and a longitudinal axis 106. In accordance with this aspect of the inventive spine board 100, the board 100 is suited with multiple instances of juxtaposed cleat arrays 114 positioned on the spine board 100 for engaging with securing means, such as straps S for securing the torso, head and neck of a patient. Each juxtaposed cleat array 114 is surrounded by an endless edge 118 that defines a through-hole or through-slot 120 through the board 100. IN the non-limiting exemplary embodiment shown, the innermost edge of 118 is suited with a series of substantially "T" shaped cleats 122 spaced apart by complimentary "T" shaped spaces 124. This arrangement of cleats 122 and spaces 124 provides a series of strap entry and anchor points to selectively attach straps S or the like to secure the head H of the patient P wearing a cervical collar C to the board 100.

As shown in FIGS. 33-34, in accordance this aspect of the inventive spine board, the multiple instances of the inventive cleat arrays 114 enable the preferred crisscrossing of straps S for securing the torso of the patient (typically, the straps crisscross around the chest area of the patient P and engage with the cleat arrays 114 located on the spine board 100 in the torso area of the patient P). The inventive cleat arrays 114 enable a rescuer to quickly secure the straps to the T-shaped cleats 122 as described herein. Also, a cervical collar C is similarly secured to immobilize the neck area of the patient P by engaging straps S with the cleat arrays 114 located on the board 100 at the neck area of the patient. The head H of the patient P can also be secured by engaging straps S with the cleat arrays 114 located on the board 100 at the head area of the patient P. In accordance with the inventive spine board 100, for example, the typically difficult task of securing a patient's head to the board 100 using, for example, tape or hook and loop fasteners, is significantly made easier by utilizing the inventive cleat arrays 114. In addition to, or instead of the T-shaped cleats 122, other embodiments of the cleats 122 described herein may be provided as the cleat arrays 114.

Figure 35:
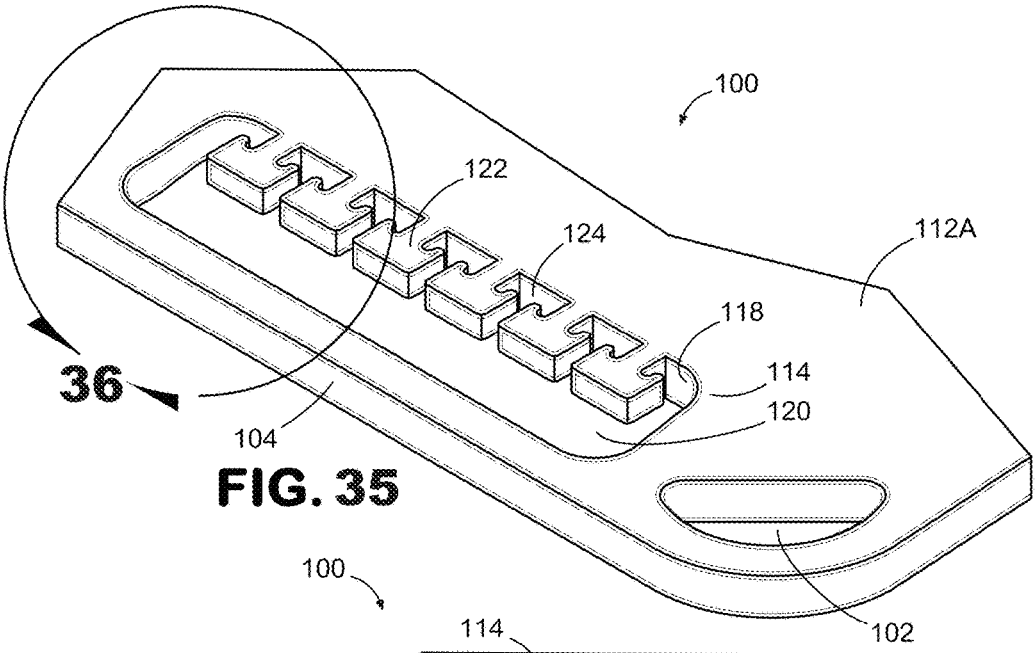
FIG. 35 is a perspective view of a fragmentary portion of the spine board showing a handhold portion having a wide handhold opening to accommodate the hands of rescue personnel.
Figure 36:
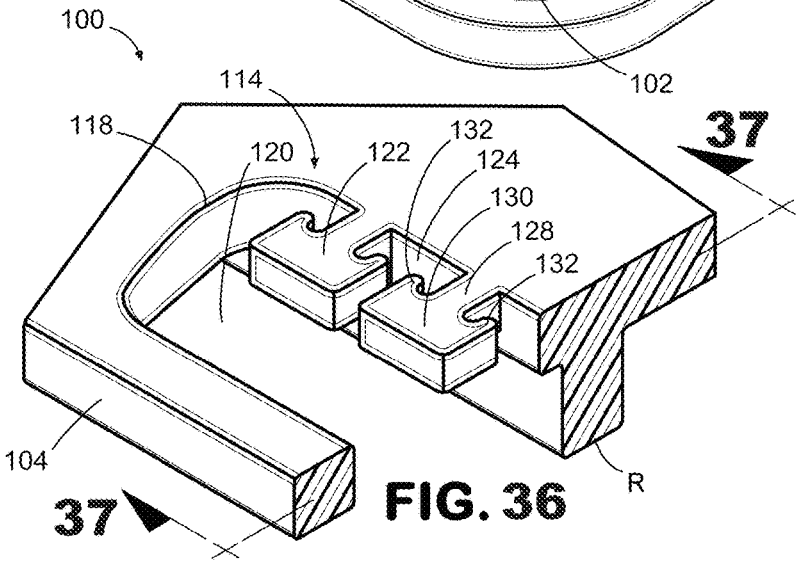
FIG. 36 is an enlarged fragmentary section view taken at inset circle 36 in FIG. 35.
Figure 37:
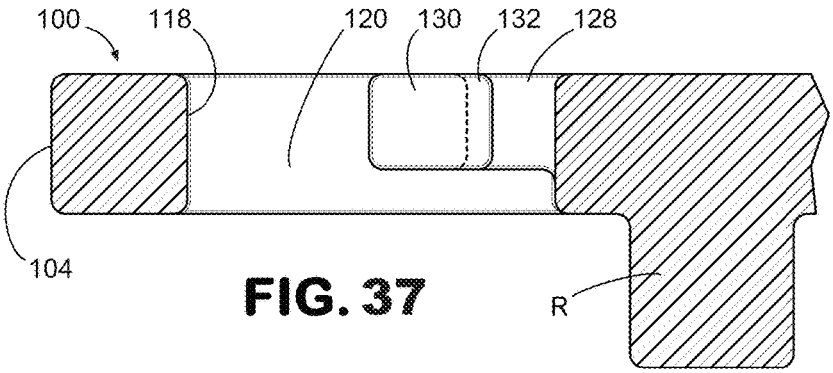
FIG. 37 is a cross-sectional view taken at lines 37-37 in FIG. 36.

FIGS. 35, 36 and 37 are views similar to FIGS. 7, 8 and 9. FIG. 35 is a perspective view of a fragmentary portion of the spine board 100 showing a handhold portion having a wide handhold opening to accommodate the hands of rescue personnel. FIG. 36 is an enlarged fragmentary section view taken at inset circle 36 in FIG. 35. FIG. 37 is a cross-sectional view taken at lines 37-37 in FIG. 36. In accordance with the inventive spine board 100 each juxtaposed cleat array 114 is surrounded by an endless edge 118 that defines a through-hole or through-slot 120 through the board 100. The though-slot 120 has a width that allows the fingers of the rescue personnel to easily pass into the through-slot 120 and grab with spine board 100, without interference from the cleat array 114 that is also disposed within the through-slot 120.

Figure 38:
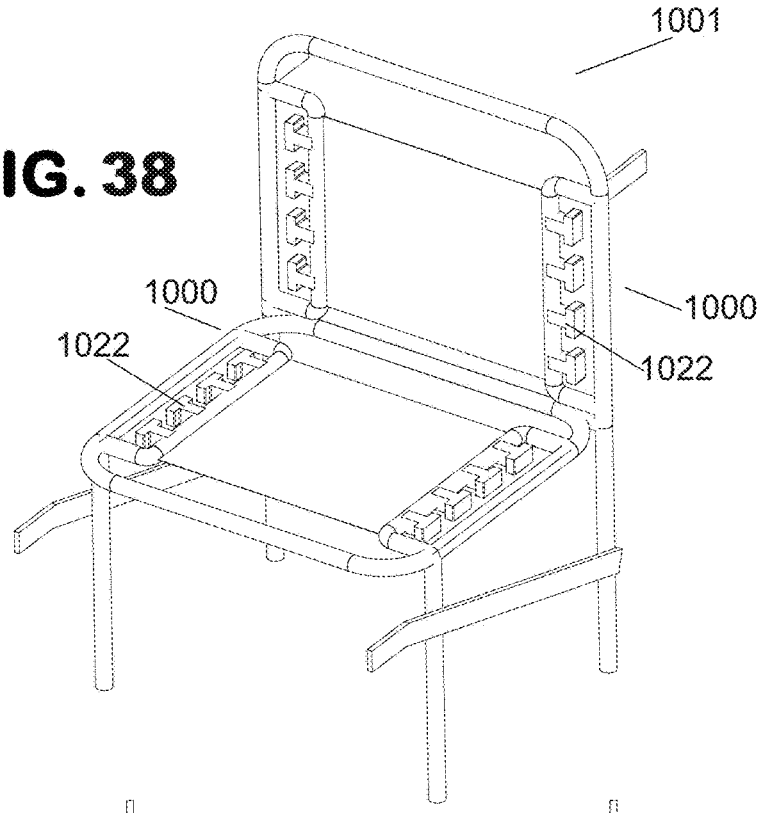
FIG. 38 is a perspective view showing another inventive embodiment configured as a stair chair.
Figure 39:
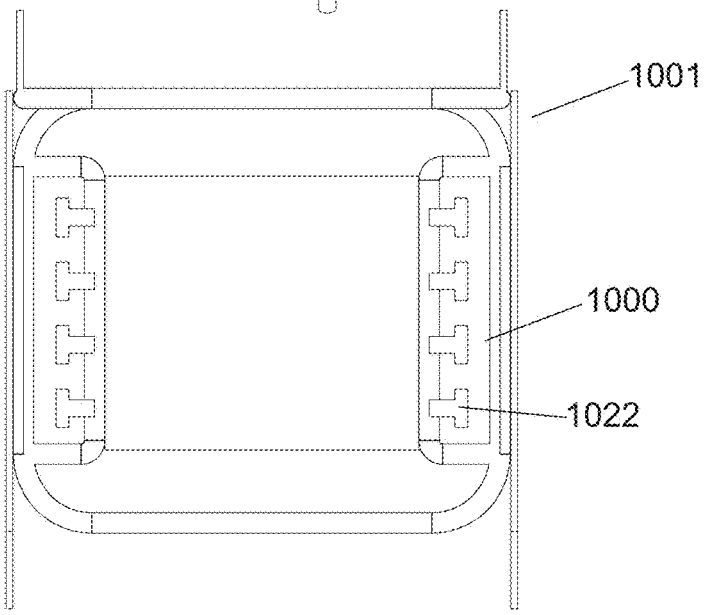
FIG. 39 is a top view inventive stair chair shown in FIG. 38. A stair chair is used, similarly to a spine board, to transport a patient.

FIG. 38 is a perspective view showing another inventive embodiment configured as a stair chair. FIG. 39 is a top view inventive stair chair shown in FIG. 38. A stair chair is used, similarly to a spine board, to transport a patient. Rather than lying on the spine board on one's back, in the case of a stair chair, the patient is transported while in a seated position. However, just as is the case with a spine board, the patient must be preferably secured to the stair chair prior to being picked up and transported. In accordance with the inventive stair chair, a retrofittable cleat array 1000 is provided for a spine board 1001. Cleats 1022 are supported in a gap 1021. Each cleat 1022 is further configured and dimensioned to receive and retain a flexible securing member, such as a strap, used for securing a patient to the stair chair 1001. Various configurations of the cleat 1022 described herein, and others, may be incorporated into this inventive stair chair 1001. Other patient transport systems can also utilize the inventive cleat arrays 1000 shown in FIGS. 38 and 39, as well as the other embodiments shown herein. For example, a stokes stretcher, often used for transporting a patient over difficult terrain or when using a helicopter for rescue, can be integrally formed or retrofitted with the embodiments of the inventive cleat arrays 1000 shown in FIGS. 38 and 39, or any of the other embodiments described herein.

With respect to the above description, it is realized that the optimum dimensional relationships for parts of the invention, including variations in size, materials, shape, form, function, and manner of operation, assembly and use, are deemed readily apparent and obvious to one skilled in the art. All equivalent relationships to those illustrated in the drawings and described in the specification are intended to be encompassed by the present invention.

The invention claimed is:

1. A cleat array for a spine board, comprising: a top plate; a cleat support structure fixed to the top plate and defining a gap; and at least one cleat supported in the gap by the cleat support structure; wherein the top plate, the cleat support structure and the at least one cleat are configured and dimensioned so that the cleat support structure and the at least one cleat are insertable into a through-slot in a pre-existing board, and the top plate is configured and dimensioned to enable the cleat support structure to be retained in the through-slot, the at least one cleat being further configured and dimensioned to receive and retain a flexible securing member used for securing a body to the board.

2. The cleat array according to claim 1; wherein the at least one cleat support structure has a at least one cleat support long axis, and the cleat comprises a post extending outward the cleat support structure and perpendicular to the cleat support long axis, the cleat being configured and dimensioned for selectively attaching securing means to secure a patient to the board.

3. The cleat array according to claim 1; wherein the cleat support structure has a cleat support long axis, said at least one cleat having a proximal end and a distal end disposed opposite the proximal end, the distal end having an engagement member configured and dimensioned to receive and retain the flexible securing member; and further comprising adjustment means for adjusting at least one of a location, angle and rotation of said at least one cleat relative to the board.

4. The cleat array according to claim 3; wherein the adjustment means comprises an elongated axle disposed within the gap, the elongated axle being oriented parallel with the cleat support long axis and spanning substantially a longitudinal length of the at least one cleat support structure, and wherein the cleat is slidably engaged at the proximal end on the elongated axle.

5. The cleat array according to claim 1; wherein the at least one cleat is a member of a cleat array disposed on the elongated axle.

6. The cleat array according to claim 1, wherein the board has a longitudinal edge wherein the cleat support structure is insertable into the board so that said at least one cleat is positioned adjacent to the longitudinal edge, said at least one cleat having a proximal end coupled to the spine board through the insertion of the cleat support structure, and a distal end disposed opposite the proximal end, the distal end having an engagement member configured and dimensioned to receive and to retain the flexible securing member used for securing the body to the board.

7. The cleat array according to claim 1; wherein the board has a board edge and a long axis and defines a through-slot disposed in the board adjacent to the board edge and parallel to the long axis; and wherein the at least one cleat comprises a post extending outward toward the board edge and perpendicular to the long axis, the at least one cleat being configured and dimensioned for selectively attaching securing means to secure a patient to the board.

8. The cleat array according to claim 7; wherein the at least one cleat comprises a post extending outward toward the board edge and perpendicular to the long axis, the post being connected to a crossbar configured and dimensioned to prevent the securing means from slipping off the at least one cleat.

9. The cleat array according to claim 8; wherein the post of the at least one cleat terminates in a downwardly angled prong disposed at a distal end of the post effective to retard the securing means from unintended disengagement from the at least one cleat.

10. The cleat array according to claim 9; wherein the downwardly angled prong terminates in a downwardly extending protrusion effective to inhibit the securing means from disengaging from the at least one cleat.

11. The cleat array according to claim 10; wherein the protrusion defines a bulbous portion so that a reduced cross-sectional area of post relative to an increased cross-sectional area of the bulbous end portion inhibit the securing means from disengaging from the at least one cleat.

12. The cleat array according to claim 7; wherein the post of the cleat terminates in a bulbous end portion so that a reduced cross-sectional area of post relative to an increased cross-sectional area of the bulbous end portion inhibit the securing means from disengaging from the at least one cleat.

13. A cleat array for a spine board, comprising: a top plate; a cleat support structure fixed to the top plate and defining a gap; and at least one cleat supported in the gap by the cleat support structure; wherein the top plate, the cleat support structure and the at least one cleat are configured and dimensioned so that the cleat support structure and the at least one cleat are insertable into a through-slot in a pre-existing board, and the top plate is configured and dimensioned to enable the cleat support structure to be retained in the through-slot, the at least one cleat being further configured and dimensioned to receive and retain a flexible securing member used for securing a body to the board, wherein the board has a longitudinal edge, the board having a long axis and defines a through-slot disposed in the board adjacent to the longitudinal edge and parallel to the long axis, the through-slot having an edge closer to a longituindal centerline of the board and an opposite edge closer to the longitudinal edge, wherein the cleat support structure is insertable into the through-slot so that the at least one cleat extends from an edge of the through-slot closer to the centerline towards an opposite edge of the through-slot closer to the longitudinal edge board so that at least one cleat is positioned adjacent to the longitudinal edge, said at least one cleat having a proximal end coupled to the spine board through the insertion of the cleat support structure, and a distal end disposed opposite the proximal end and terminating before the opposite edge of the through-slot closer to the longitudinal edge, the distal end having an engagement member configured and dimensioned to receive and to retain the flexible securing member used for securing the body to the board.

14. The cleat array according to claim 13; wherein the cleat support structure has a at least one cleat support long axis, and the cleat comprises a post extending outward the at least one cleat support structure and perpendicular to the cleat support long axis, the cleat being configured and dimensioned for selectively attaching securing means to secure a patient to the board.

15. The cleat array according to claim 13; wherein the cleat support structure has a cleat support long axis, said at least one cleat having a proximal end and a distal end disposed opposite the proximal end, the distal end having an engagement member configured and dimensioned to receive and retain the flexible securing member; and further comprising adjustment means for adjusting at least one of a location, angle and rotation of said at least one cleat relative to the board.

16. The cleat array according to claim 15; wherein the adjustment means comprises an elongated axle disposed within the gap, the elongated axle being oriented parallel with the cleat support long axis and spanning substantially a longitudinal length of the cleat support structure, and wherein the at least one cleat is slidably engaged at the proximal end on the elongated axle.

17. The cleat array according to claim 13; wherein the at least one cleat is a member of a cleat array disposed on the elongated axle.

18. The cleat array according to claim 13; wherein the board has a board edge and a long axis and defines a through-slot disposed in the board adjacent to the board edge and parallel to the long axis; and wherein the at least one cleat comprises a post extending outward toward the board edge and perpendicular to the long axis, the at least one cleat being configured and dimensioned for selectively attaching securing means to secure a patient to the board.

19. The cleat array according to claim 18; wherein the at least one cleat comprises a post extending outward toward the board edge and perpendicular to the long axis, the post being connected to a crossbar configured and dimensioned to prevent the securing means from slipping off the at least one cleat.

20. The cleat array according to claim 19; wherein the post of the at least one cleat terminates in a downwardly angled prong disposed at a distal end of the post effective to retard the securing means from unintended disengagement from the at least one cleat.

* * * * *